US008403383B2

(12) United States Patent
McFadden et al.

(10) Patent No.: US 8,403,383 B2
(45) Date of Patent: Mar. 26, 2013

(54) PRINT UNIT LATCH

(75) Inventors: Bruce A. McFadden, Vancouver, WA (US); Jeffrey T. Hendricks, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1062 days.

(21) Appl. No.: 12/249,900

(22) Filed: Oct. 10, 2008

(65) Prior Publication Data

US 2010/0091068 A1 Apr. 15, 2010

(51) Int. Cl.
*B65D 45/02* (2006.01)

(52) U.S. Cl. ..... 292/257; 292/7; 292/46; 292/47; 292/216; 347/49

(58) Field of Classification Search ..... 347/49; 292/47, 257, 216, 7
See application file for complete search history.

(56) References Cited

U.S. PATENT DOCUMENTS

| | | | | | |
|---|---|---|---|---|---|
| 350,332 | A | * | 10/1886 | White | 292/210 |
| 2,324,356 | A | * | 7/1943 | Brown | 220/314 |
| 5,152,559 | A | * | 10/1992 | Henrichs | 292/113 |
| 5,534,899 | A | | 7/1996 | Uchikata et al. | |
| 5,620,212 | A | * | 4/1997 | Bourne et al. | 292/113 |
| 5,737,001 | A | | 4/1998 | Taylor | |
| 5,940,097 | A | | 8/1999 | Imai | |
| 6,015,959 | A | * | 1/2000 | Slepian et al. | 200/400 |
| 6,170,940 | B1 | * | 1/2001 | Shinada et al. | 347/86 |
| 6,250,750 | B1 | * | 6/2001 | Miyazawa et al. | 347/87 |
| 6,367,918 | B1 | * | 4/2002 | Heiles et al. | 347/86 |
| 6,386,681 | B1 | * | 5/2002 | Askren et al. | 347/49 |
| 6,481,829 | B1 | * | 11/2002 | Bailey et al. | 347/49 |
| 6,623,105 | B1 | * | 9/2003 | Shen | 347/49 |
| 6,953,242 | B2 | * | 10/2005 | Yoshiyama et al. | 347/86 |
| 6,997,628 | B2 | | 2/2006 | Tu | |
| 7,178,909 | B2 | * | 2/2007 | Yoshiyama et al. | 347/86 |
| 2006/0044371 | A1 | | 3/2006 | Inoue | |

* cited by examiner

*Primary Examiner* — Mark Robinson
*Assistant Examiner* — Andrew Jordan

(57) ABSTRACT

An apparatus and a method retain a print unit in a dock with a retainer that is at least partially below a top of a fluid supply of the print unit.

22 Claims, 7 Drawing Sheets

PRINT UNIT LATCH

BACKGROUND

Print units supply printing fluid for printing and may be retained in a carriage dock with a latch. Existing latches are not compact and may increase a height of the printer. Existing latches are visually obstructive and make insertion or withdrawal of the print units less intuitive.

DETAILED DESCRIPTION OF THE EXAMPLE EMBODIMENTS

Figure 1:
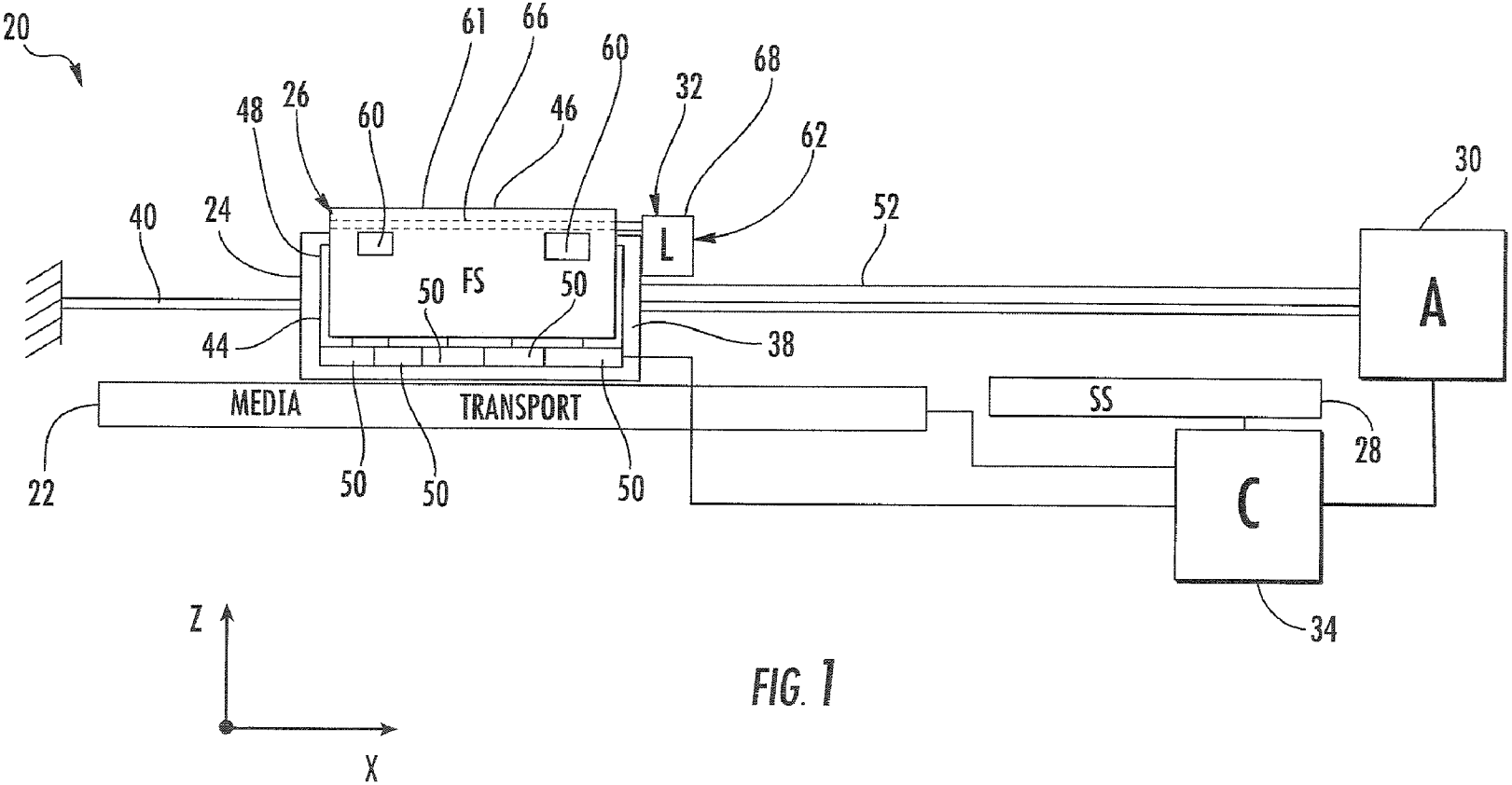
FIG. 1 is a side elevational view schematically illustrating a printer according to an example embodiment.

FIG. 1 schematically illustrates printer 20 according to an example embodiment. As will be described hereafter, printer 20 includes a latch system that locates and retains a print unit in a carriage dock in a more compact manner and a less visually obstructive manner. Printer 20 includes media transport 22, carriage 24, print unit 26, service station 28, actuator 30, latch system 32 and controller 34.

Media transport 22 comprises mechanisms configured to transfer port media relative to print unit 24. In one embodiment, media transport comprises a series of belts, rollers and the like configured to transport sheets of media. In another embodiment, media transport 22 comprises a drum configured to carry one or more sheets of media through print zones opposite to print unit 26. In yet another embodiment, media transport 22 may be configured to drive or move a web of printing material.

Carriage 24 comprises one or more structures configured to carry or move print unit 26 across media transport 22, allowing print unit 26 to deposit printing material across a print medium. In the example illustrated, carriage 24 comprises one or more structures which form a cavity, opening, recess or dock 38 configured to removably receive print unit. 26. In one embodiment, dock 38 is configured to permit print unit 26 to be inserted into dock 38 or to be withdrawn from dock 38 without the use of any tools. In the example illustrated, carriage 24 is slidably supported along a guide rod 40 and is driven transversely across media transport 22 and the medium supported by media transport 22. In other embodiments, carriage 24 may be movably supported across or opposite to media transport 22 in other fashions.

Print unit 26 comprises a unit configured to deposit printing material, such as printing fluid, onto media transported by media transport 22 as print unit 26 is carried across media transport 22. In the example illustrated, print unit 22 comprises a two-part unit including a carrier 44 and a fluid supply 46. Carrier 44 comprises a structure configured to removably receive and contain fluid supply 46 while directing fluid from the fluid supply onto print media. Carrier 44 includes a frame 48 which supports one or more print heads 50. In the example illustrated, frame 48 includes five print heads 50, wherein each print head or group of print heads is configured to deposit a different printing fluid onto print media. For example, in one embodiment, one print head 50 is configured to deposit black ink while the remaining print heads are configured to deposit cyan, magenta and yellow inks. The fifth print head is configured to deposit a fixer. In other embodiments, frame 48 may be configured to carry a greater or fewer of such print heads. In other embodiments, the print heads may be configured to eject other colors of ink or other types of printing fluids or printing materials. In other embodiments, a greater or fewer number of such print heads 50 may be provided. In one embodiment, each print head 50 comprises a thermoresistance inkjet print head (also known as a thermal ink jet printhead). In another embodiment, each print head 50 may comprise a piezo resistive or piezo electric inkjet print head or other types of drop-on-demand inkjet print heads.

Fluid supply 46 comprises one or more containers or vessels containing printing fluid. Fluid supply 46 is configured to be removably inserted into carrier 44. Upon being fully inserted into frame 48 of carrier 44, fluid supply 46 is fluidly connected to each of print heads 50. In one embodiment, fluid supply 46 includes a plurality of chambers containing different printing or marking fluids, wherein each chamber is fluidly connected to a distinct print head 50 or group of print heads 50 of carrier 44. In other embodiments in which carrier 44 includes a single print head 50, fluid supply 46 may include a single chamber.

Because print unit 26 is a two-part system including carrier 44 and fluid supply 46, each of carrier 44 and fluid supply 46 may be more easily repaired, refurbished or replaced. In other embodiments, however, carrier 44 and print unit 46 may alternatively be configured as a single unitary body, wherein fluid supply 46 is an integral part of carrier 44 and print heads 50.

Service station 28 comprises one or more structures configured to service print heads 50 of print unit 26. For example, in one embodiment, service station 28 is configured to perform such servicing operations such as wiping of the nozzles of print heads 50, spitting of print heads 50 or capping of print heads 50 when print heads 50 are not being used. Although service station 28 is illustrated as extending along a transverse side of media transport 28, in other embodiments, service station 28 may be provided at other locations. In other embodiments, service station 28 may be omitted.

Actuator 30 comprises a mechanism configured to move carriage 24 and print unit 26 transversely across media transport 22 and the media supported by media transport 22. Actuator 30 is further configured to move carriage 24 and print unit 26 two positions opposite to service station 28 for print head servicing. In one embodiment, actuator 30 comprises a motor configured to drive a cable or belt 52 connected to carriage 24 so as to move carriage 24 along guide rod 40. In another embodiment, actuator 30 may comprise a rack and pinion arrangement configured to move carriage 24 along guide rod 40 or along some other guide structure. In yet other embodiments, the actuator 30 may comprise other mechanisms configured to move carriage 24 relative to the media being printed upon.

Latch system 32 secures and retains print unit 26 within dock 38 of carriage 24. Latch system 32 further urges print unit 26 against surfaces or datums of dock 38 to reliably retain and locate print heads 50 along with their associated electrical contacts. Latch system 32 achieves both these functions in a compact manner without substantially increasing the height of printer 20 and without being visually obstructive. As a result, latch system 32 facilitates more visually intuitive insertion in connection of print unit 26 to dock 38.

Latch system 32 generally includes projections 60 and print unit latch 62. Projections 60 extend from frame 48 of carrier 44 and are configured to be engaged by latch 62. In the example illustrated, projections 60 are located so as to extend below a top surface 61 of fluid supply 46 when fluid supply 46 is received and fitted within frame 48. In the example illustrated, projections 60 each comprise a hook adding an upwardly facing notch configured to be engaged or contacted by latch 62. In other embodiments, latch system 32 may include other types the projections or a greater or fewer of such projections extending from frame 48 of carrier 44. In yet other embodiments, latch system 32 may include projections that alternatively extend from fluid supply 46.

Print unit latch 62 engages projections 60 to retain and position print unit 26 in dock 38. Print unit latch 62 includes retainer 66 and latch camming system 68. Retainer 66 comprises one or more members which are movable between (1) a projection engaging position in which retainer 66 contacts, abuts and applies force against projections 60 to secure print unit 26 in place and to apply force to print unit 26 to urge print unit 26 against datum surfaces and (2) a withdrawn position allowing print unit 26 to be removed from dock 38 or allowing print unit 26 to be inserted into dock 38. In one embodiment, retainer 66 engages carriage 24 while it engages projections 60 in the projection engaging position to position the print unit in the Y-axis direction. In the example illustrated, retainer 66 comprises an elongate rod or bar extending across and above both the projections 60, yet extending below top 61 of fluid supply 46. In other embodiments, retainer 66 may comprise other structures, such as pairs of hooks, catches or the like which are movable between the noted positions.

Latch camming system 68 comprises a cam and associated cam follower configured to cooperate with one another to move retainer 66 between the engaging position and the withdrawn position. Latch camming system 68 is manually movable and further retains retainer 66 in either the engaging position or the withdrawn position without having to be held in place, freeing a person's hands during insertion or withdrawal of print unit 26. Like retainer 66, latch camming system 68 extends substantially below a top 61 of fluid supply 46 when fluid supply 62 is retained within dock 38. As a result, latch camming system 68 does not potentially increase the height (the Z-axis direction shown in FIG. 1) of printer 20.

Although retainer 66 and latch camming system 68 may extend above fluid supply 46 or above dock 38 during insertion of print unit 26 or withdrawal print unit 26, during such insertion or withdrawal of a print unit 26, carriage 24 may be positioned opposite to service station 28 or at other locations offset from media transport 22 where printer 20 may have extra vertical space for accommodating the open positions of retainer 66 and camming system 68. However, when camming system 68 and retainer 66 are engaging and securing print unit 26 in place (such as when carriage 24 is being moved by actuator 30 across media transport 22), retainer 66 and camming system 68 are substantially below a top of fluid supply 46 as print unit 26 is carried across media transport 22. As a result latch system 32 does not occupy valuable space above media transport 22 and above the print media, allowing additional height to be provided for media transport 22 or for volumes or spaces within printer 20 for containing media to be printed upon or media that has been printed upon.

Controller 34 comprises one or more processing units configured to generate control signals directing the operation of printer 20. In particular, controller 34 generates control signals directing the ejection of fluid by print heads 50 of print unit 26. Controller 34 generates control signals directing actuator 30 to selectively move carriage 24 and print unit 26 across media transport 22 and the media being printed upon. Controller 34 further generates control signals directing the transporter media by media transport 22 relative to print heads 50. Controller 34 also generates control signals directing the operation of service station 28.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 34 may be embodied as part of one or more application-specific integrated circuits (ASICs). Unless otherwise specifically noted, the controller is not limited to any specific combination of hardware circuitry and software, nor to any particular source for the instructions executed by the processing unit.

FIGS. 2-7 illustrate printer 120, another embodiment of printer 20 shown in FIG. 1. Like printer 20, printer 120 has a latch system configured to removably retain and secure a print unit in place as a print unit is carried across media being printed upon. Like latch system 32 of printer 20, the latch system of printer 120 locates and retains a print unit in a carriage dock in a compact manner and in a visually unobstructive manner.

Printer 120 includes media transport 22, service station 28, actuator 30 and controller 34, each of which is schematically shown in and described with respect to FIG. 1. Printer 120 additionally includes carriage 124, print unit 126 and latch system 132, particular embodiments of carriage 24, print unit 26 and latch system 32, respectively, shown in FIG. 1. Carriage 124 comprises one or more structures configured to carry or move print unit 126 across media transport 22 (shown in FIG. 1), allowing print unit 126 to deposit printing material across a print medium. In the example illustrated, carriage 124 comprises one or more structures which form a cavity, opening, recess or dock 138 configured to removably receive print unit 126. In one embodiment, dock 138 is configured to permit print unit 126 to be inserted into dock 138 or to be withdrawn from dock 138 without the use of any tools.

Figure 2:
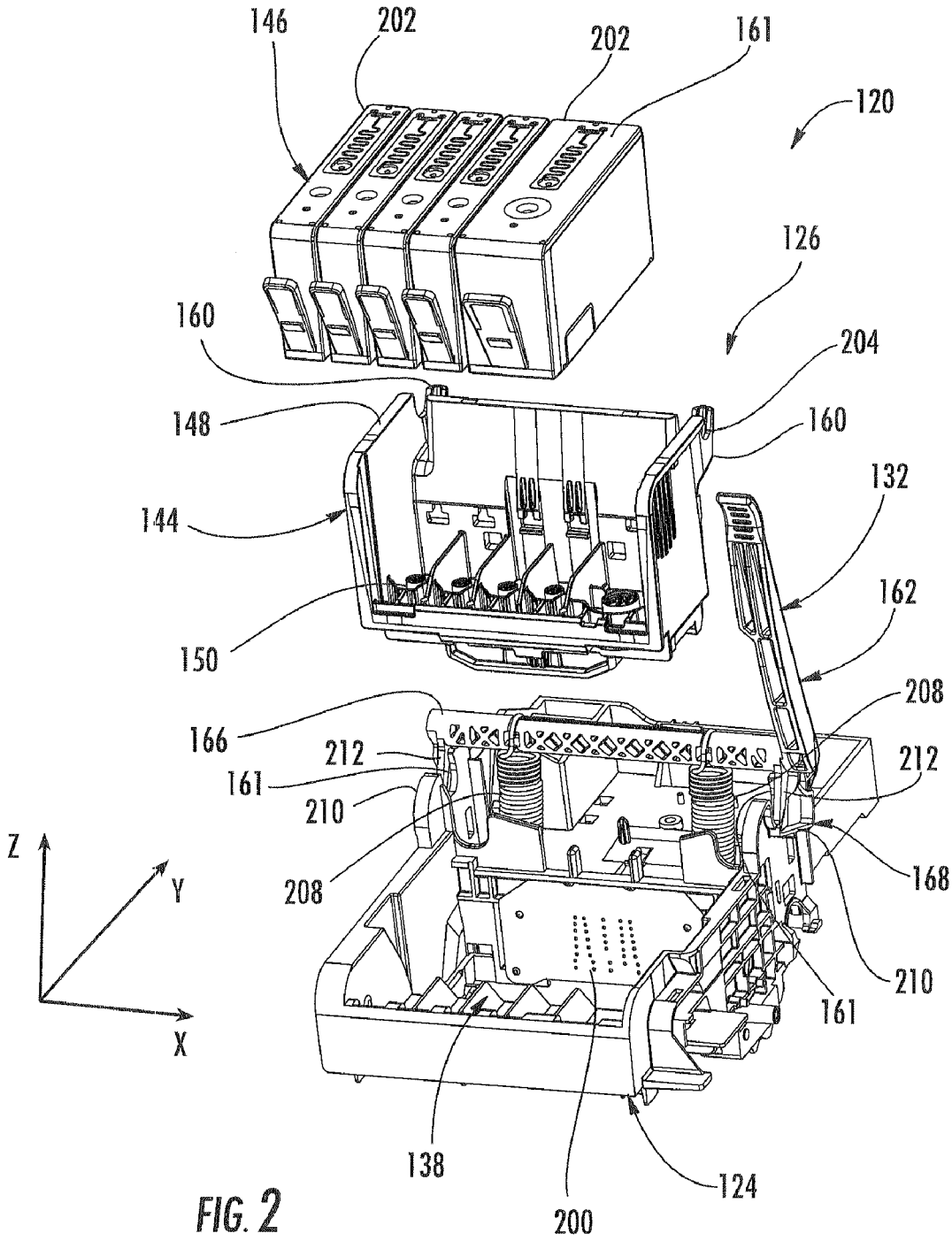
FIG. 2 is a top exploded perspective view of another embodiment of the printer of FIG. 1, illustrating a carriage, a print unit and a latch system of the printer according to an example embodiment.

As shown by FIG. 2, carriage 124 additionally includes a print unit interface having signal and power transmitting contact pads or contacts 200. Contacts 200 make electrical connection with corresponding contacts on printing unit 126 so as to transmit power and print control signals from controller 34 (shown in FIG. 1) to print unit 126. In the example illustrated, such electrical, optical or other communication contacts 200 are located adjacent to dock 138 rearward (in a positive Y-axis direction) of dock 138. As will be described hereafter, latching mechanism 132 provides greater visibility of such interface contacts 200, making insertion of print unit 126 and it's interface contacts into dock 138 more intuitive and more verifiable.

In the example illustrated, carriage 24 is slidably supported along a guide rod 40 and is driven transversely across media transport 22 and the medium supported by media transport 22. In other embodiments, carriage 24 may be movably supported across or opposite to media transport 22 in other fashions.

Print unit 126 comprises a unit configured to deposit printing material, such as printing fluid, onto media transported by media transport 22 (shown in FIG. 1) as print unit 126 is carried across media transport 22. In the example illustrated, print unit 126 comprises a two-part unit including a carrier 144 and a fluid supply 146. Carrier 144 comprises a structure configured to removably receive and contain fluid supply 146 while directing fluid from the fluid supply onto print media. Carrier 144 includes a frame 148 which supports one or more print heads 150. In the example illustrated, frame 148 includes five print heads 150, wherein each print head or group of print heads is configured to deposit a different printing fluid onto print media. For example, in one embodiment, one print head 150 is configured to deposit black ink while the remaining print heads 150 are configured to deposit cyan, magenta and yellow inks. The fifth print head is configured to deposit a fixer. In other embodiments, frame 148 may be configured to carry a greater or fewer of such print heads. In other embodiments, the print heads may be configured to eject other colors of ink or other types of printing fluids or printing materials. In one embodiment, each print head 150 comprises a thermoresistance (thermal ink jet) inkjet print head. In another embodiment, each print head 150 may comprise a piezo resistive inkjet print head or other type of drop-on-demand inkjet print head.

Fluid supply 146 comprises one or more containers or vessels containing printing fluid. Fluid supply 146 is configured to be removably inserted into carrier 144. Upon being fully inserted into frame 148 of carrier 144, fluid supply 146 is fluidly connected to each of print heads 150. In one embodiment, fluid supply 146 includes a plurality of chambers 202 containing different printing fluids, wherein each chamber is fluidly connected to a different print head 150 or different group of print heads 150 of carrier 144. In other embodiments in which carrier 44 includes a single print head 150, fluid supply 146 may include a single chamber 202.

Because print unit 126 is a two-part system, including carrier 144 and fluid supply 146, each of carrier 144 and fluid supply 146 may be more easily repaired, refurbished or replaced. In other embodiments, however, carrier 144 and print unit 146 may alternatively be configured as a single unitary body, wherein fluid supply 146 is an integral part of carrier 144 and print heads 150.

Latch system 132 secures and retains print unit 126 within dock 138 of carriage 124. Lack system 132 further urges print unit 126 against surfaces or datums of dock 138 to reliably retain and locate print heads 150 along with their associated electrical contacts. Latch system 132 achieves both these functions in a compact manner without substantially increasing the height of printer 120 and without being visually obstructive. As a result, latch system 132 facilitates more visually intuitive insertion in connection of print unit 126 to dock 138.

Latch system 132 generally includes projections 160, carriage vee or notches 161 and print unit latch 162. Projections 160 extend from frame 148 of carrier 144 and are configured to be engaged by latch 162. In the example illustrated, projections 160 are located so as to extend below a top surface 163 of fluid supply 146 when fluid supply 146 is received and fitted within frame 148. In the example illustrated, projections 160 each comprise a hook adding an upwardly facing notch 204 configured to be engaged or contacted by latch 162. In other embodiments, latch system 132 may include other types the projections or a greater or fewer of such projections extending from frame 148 of carrier 144. In yet other embodiments, latch system 132 may include projections that alternatively extend from fluid supply 146.

Carriage notches 161 comprise detents or other surfaces coupled to or supported by carriage 124 which are configured to engage or contact a portion of print unit latch 162 to facilitate securing and positioning of print unit 126 in the Y-axis direction. As shown by FIG. 2, carriage notches 161 extend along opposite sides of dock 138. In other embodiments, such surfaces coupled to and supported by carriage 124 may have other configurations other than notches while still cooperating with latch 162 to position print unit 126 in the Y-axis direction.

Print unit latch 162 engages projections 160 to retain in position print unit 126 in dock 138. Print unit latch 162 includes retainer 166 and latch camming system 168. Retainer 166 comprises one or more members which are movable between (1) a projection engaging position (shown in FIG. 5) in which retainer 166 contacts, abuts and applies force against projections 160 to secure print unit 126 in place and to apply force to print unit 126 to urge print unit 126 against datum surfaces and (2) a withdrawn position allowing print unit 126 to be removed from dock 138 or allowing print unit 126 to be inserted into dock to 138. In the example illustrated, retainer 166 comprises an elongate rod or bar extending across and above both the projections 160, yet extending below top 163 of fluid supply 146. In other embodiments, retainer 166 may comprise other structures, such as pairs of hooks, catches or the like which are movable between the noted positions.

Latch camming system 168 moves and retains retainer 166 between the engaging position and the withdrawn position. Latch camming system 168 is manually movable and further retains retainer 166 in either the engaging position or the withdrawn position without having to be held in place, freeing a person's hands during insertion or withdrawal of print unit 26. Like retainer 166, latch camming system 168 extends substantially below a top surface 161 of fluid supply 146 when fluid supply 162 is retained within dock 138. As a result, latch camming system 168 does not increase the height (the Z-axis direction shown in FIG. 1) of printer 120.

Although retainer 166 and latch camming system 168 may extend above fluid supply 146 or above dock 138 during insertion of print unit 126 or withdrawal of print unit 126, during such insertion or withdrawal of a print unit 126, carriage 124 may be positioned opposite to service station 28 or at other locations offset from media transport 22 where printer 120 may have extra vertical space for accommodating the open positions of retainer 166 and camming system 168. However, when camming system 168 and retainer 1166 are engaging and securing print unit 126 in place (such as when carriage 124 is being moved by actuator 30 across media transport 22), retainer 166 and camming system 168 are substantially below a top of fluid supply 46 as print unit 26 is carried across media transport 22. As a result, latch system 132 does not occupy valuable space above media transport 22 and above the print media, allowing additional height to be provided for media transport 22 or for volumes or spaces within printer 120 for containing media to be printed upon or media that has been printed upon.

Figure 3:
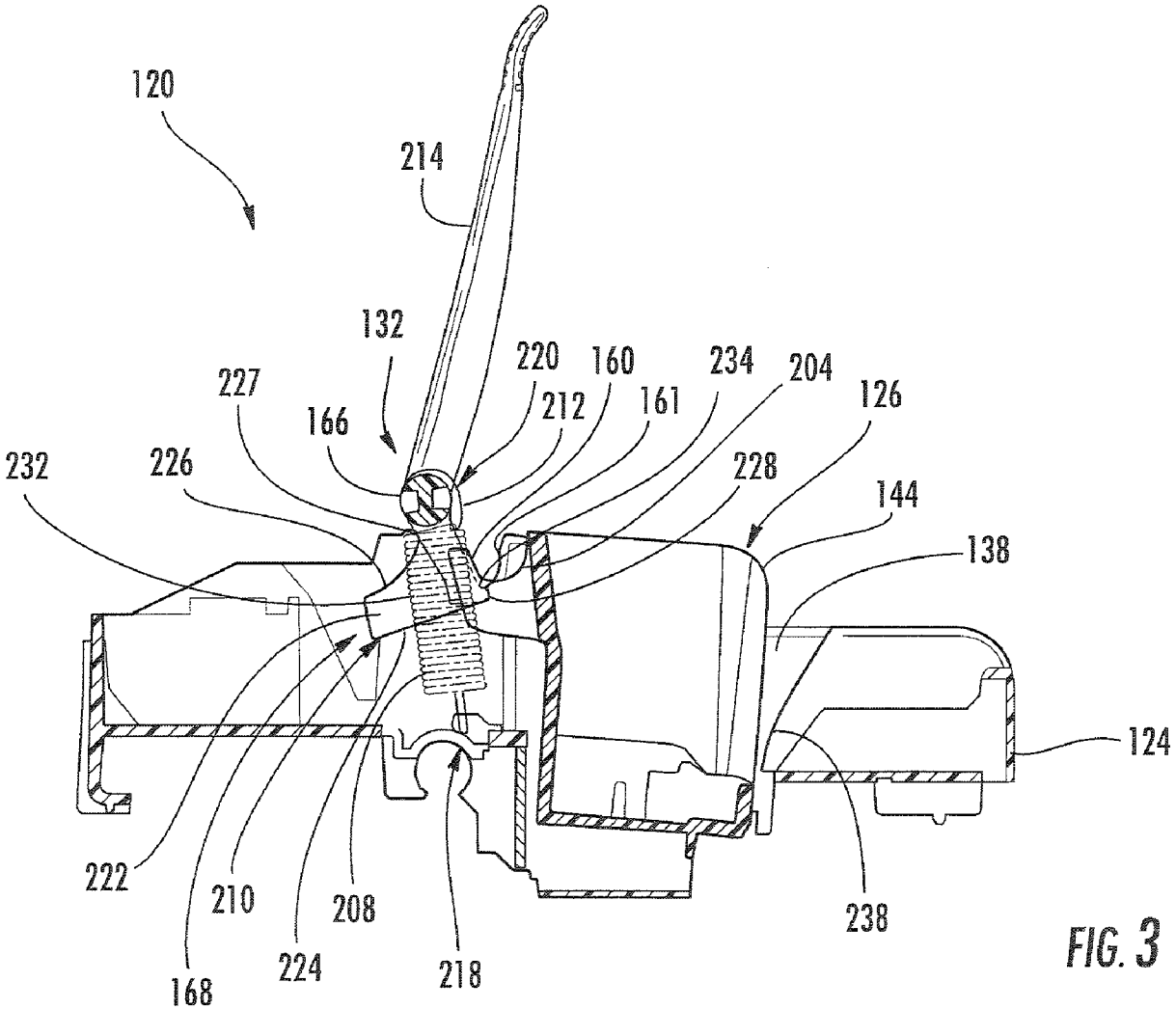
FIG. 3 is a side elevational view of the printer of FIG. 2 illustrating the latch system in an open state according to an example embodiment.
Figure 4:
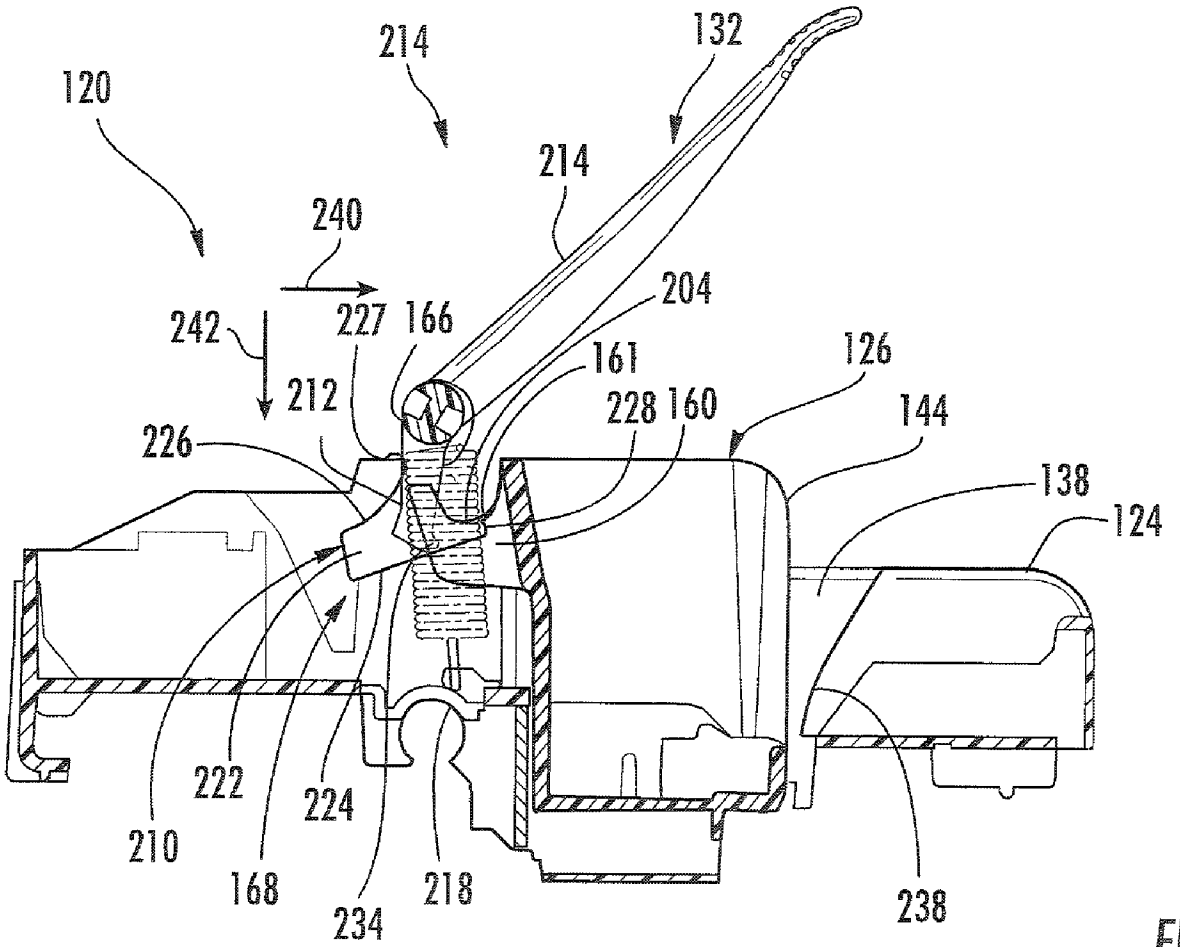
FIG. 4 is a side elevational view of the printer of FIG. 2 illustrating the latch system in an intermediate state according to an example embodiment.
Figure 5:
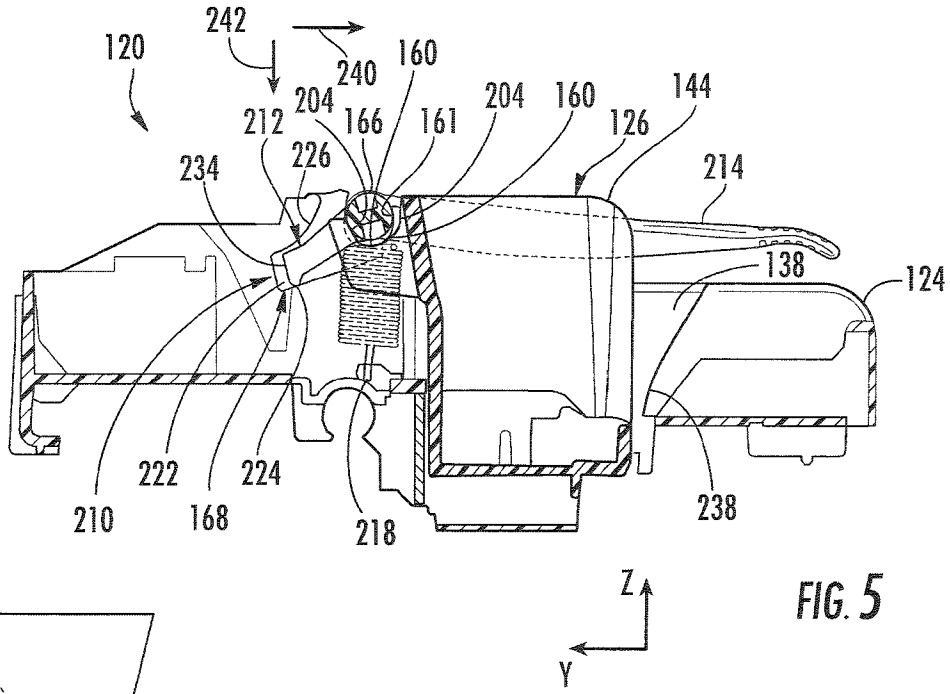
FIG. 5 is a side elevational view of the printer of FIG. 2 illustrating the latch system in a closed, print unit retaining state according to an example embodiment.

FIGS. 3-5 illustrate latch camming system 168 in more detail. FIG. 3 illustrates latch camming system 168 in an open position or state in which retainer 166 is raised out of contact with or withdrawn from projections 160, allowing carrier 144 (and fluid supply 146) to be withdrawn from dock 138 or to be inserted into dock 138. As shown by FIG. 3, latch camming system 168 includes springs 208, cam 210, cam follower 212 and lever 214. Springs 208 resiliently bias the bar of retainer 166 towards a projection engaging position to retain retainer 166 in the projection engaging position. Springs 208 further resilient bias retainer 166 towards a fully open position withdrawn from projection 160 to retain retainer 166 in the fully open position.

Figure 7:
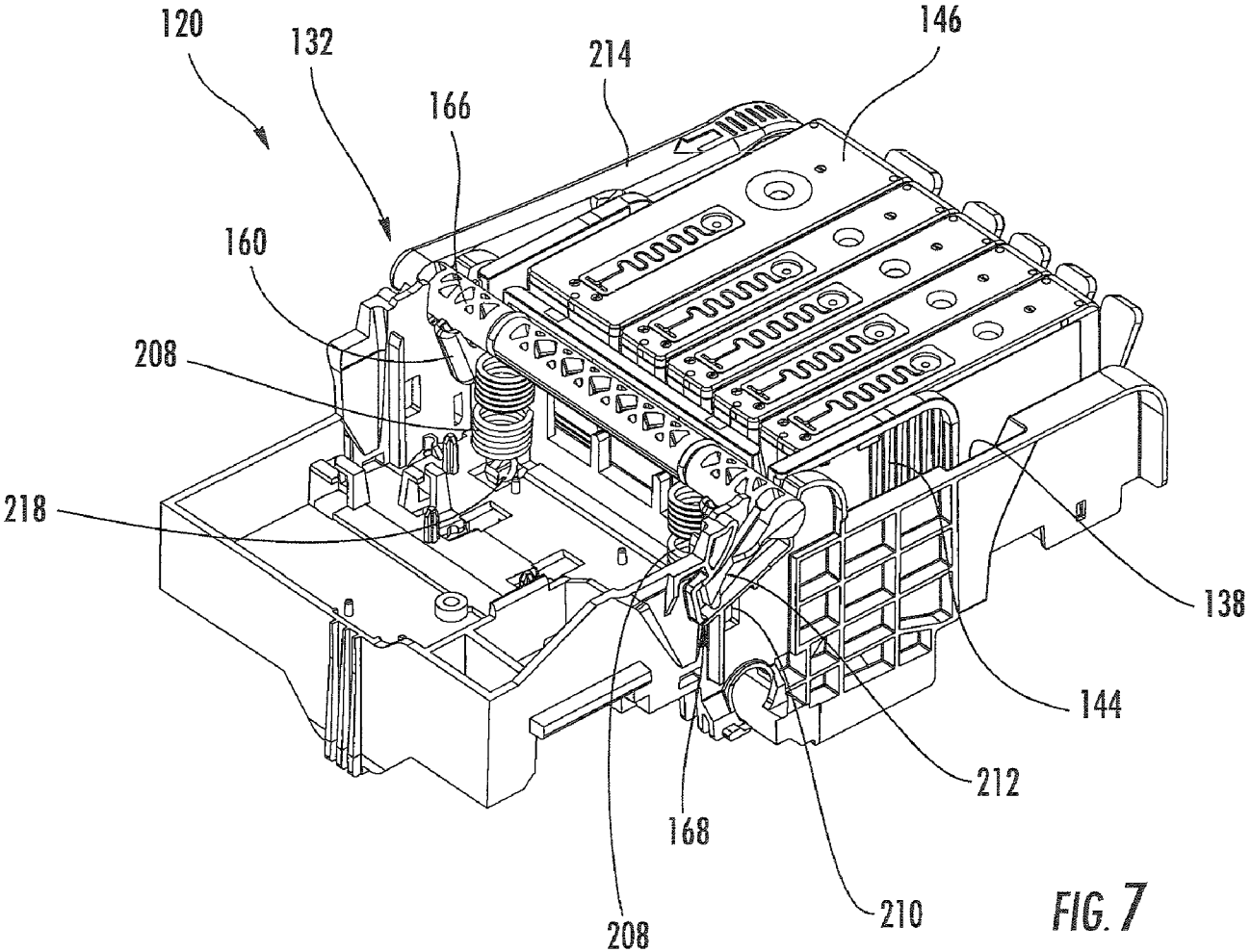
FIG. 7 is a top front perspective view of the printer of FIG. 5 according to an example embodiment.

In the example illustrated, springs 208 comprise tension springs (both of which are shown in FIGS. 2 and 7) that are located on opposite sides of an axial center point of retainer 166. Each spring 208 has a first end 218 secured to carriage 124 and a second opposite end 220 secured to and wrapped about retainer 166. In other embodiments, other types of springs or other bias mechanisms may be used to resiliently bias or urge bar of retainer 166 and its associated cam follower 212 towards either the projection engaging position or the fully open or withdrawn position depending upon the position of lever 214.

Cam 210 cooperates with cam follower 212 to move retainer 166 along a defined path in response to movement of lever 214. Cam 210 is coupled to carriage 124 and extends along at least one side of dock 138. In the example illustrated, cam 210 is integrally formed as part of a single unitary body with a side wall of carriage 124 adjacent to dock 138. Cam 210 includes a cavity 222 which receives cam follower 212 and is bordered or defined by an inclined or ramp surface 224, an arcuate or curved fulcrum surface 226, a stop surface 227 and a forward catch 228.

Ramp surface 224 comprises a floor of cavity 222 along which cam follower 212 slides and rides in response to a rotation of cam follower 212 within cavity 222. Fulcrum surface 226 extends generally opposite to surface 224 and assists in retaining cam follower 212 within cavity 222. In some embodiments, surface 226 may bear against a top of cam follower 212 to assist in pivoting cam follower 212 as it rides along surface 224. Forward catch 228 comprises a groove, channel or other set of surfaces configured to receive cam follower 212 and to prevent further movement of cam follower 212 to the right (as seen in FIG. 3) and counterclockwise rotation of cam follower 212 (as seen in FIG. 3). Catch 228 cooperates with springs 208 to retain lever 214 and retainer 166 in the fully open or withdrawn position.

Cam follower 212 comprises a structure coupled to retainer 166 such that as cam follower 212 moves along cam 210, retainer 166 moves along a defined path. Cam follower 212 is configured such that as cam follower 212 is rotated by lever 214, cam follow 212 moves along cam 210 to move retainer 166 between the withdrawn position shown in FIG. 3 and the projection engaging position shown in FIGS. 5-7. In the example illustrated, each side of dock 138 includes a cam 210 and a cam follower 212 to facilitate uniform movement of retainer 166 across a transverse width of print unit 126.

Cam follower 212 includes a leg 232 and a foot 234. Leg 232 extends from the retainer 166 and is fixedly secured to retainer 166. Foot 234 projects from leg 232 and serves as a bearing by which cam follower 212 slides along surface 224. Foot 234 simply drops into cavity 222 of cam 210 and is solely retained within the cavity 222 by springs 208. As a result, assembly of latch system 132 is simplified.

Cam follower 212 is further configured to be removably received within or engaged by catch 228 when cam follower 212 is at an end of travel position in which retainer 166 is in the withdrawn position shown in FIG. 3. In the example illustrated, cam follower 212 is integrally formed as a single unitary body with retainer 166. In other embodiments, cam follower 212 may alternatively be coupled to retainer 166 by welding, bonding, adhesives, snap fit connections and the like.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Lever 214 comprises a structure configured to be manually grasped by a person so as to actuate or move cam follower 212 along cam 210, thereby moving retainer 166 between the projection engaging position and the withdrawn position. Lever 214 is coupled to both cam follower 212 and retainer 166 such that movement of lever 214 results in movement of cam follower 212 and retainer 166. Lever 214 is configured to move along a path defined by the inter-engagement of cam follower 212 and cam 210. In particular, lever 214 pivots about an axis and also translates along a path. Lever 214 is integrally formed as a single unitary body with retainer 166. As a result, lever 214, retainer 166 and cam follower 212 may be formed in a single molding process, allowing enhanced control over the shape, dimensions and tolerances of lever 214, retainer 166 and cam follower 212. This may result in enhanced positional control of retainer 166. In other embodiments, lever 214 may be coupled to retainer 166 and follower 212 in other fashions such as by welding, adhesives, snap fit connections and the like.

FIGS. 3-7 illustrate operation of camming system 168. In particular, FIGS. 3-7 illustrate insertion and securement of print unit 126 in dock 138. Of course, the steps shown in FIGS. 3-7 may be reversed in order to withdraw print unit 126 from dock 138. As noted above, FIG. 3 illustrates latch system 132 in an open state and retainer 166 in the fully open or withdrawn position. FIG. 2 also illustrates retainer 166 in the fully open or withdrawn position. In this state or position, foot 234 of cam follower 212 is captured within catch 228. Springs 208 are stretched and exert a force upon retainer 166 which creates a counter clockwise moment upon cam follower 212 and lever 214. As a result, springs 208 resiliently urge and retain foot 234 against catch 228 and resiliently urge cam follower 212 against stop surface 227 and resiliently urge and retain retainer 166 and lever 214 in the fully open or withdrawn position shown. As a result, a person's hands are freed to insert print unit 226 into dock 138 without having to maintain control over or hold onto lever 214.

As further shown by FIG. 3, in the fully withdrawn state are position, retainer 166 is completely withdrawn from above the cavity of dock 138 (to the left of dock 138 as seen in FIG. 3). Retainer 166 is also in an elevated state, wherein a majority, if not substantially all, of retainer 166 is above a top of print unit 126 including a top of carrier 144 and fluid supply 146. As a result, latch system 132 provides greater visual and physical access. In particular, latch system 132 provides a person inserting-print unit-126 with greater visibility of the cavity of dock 138 and of interface contacts 200. Because latch system 132 is less visually obstructive and provides such greater visibility, insertion of print unit 126 into dock 138 is more intuitive and less uncertain. In addition, latch system 132 provides the person with a greater number of kinematic paths or kinematic path choices for successfully inserting print unit 126 into dock 138, simplifying such insertion. In other words, a person inserting print unit 126 into dock 138 is less likely to encounter an obstruction resulting from contact with carriage 124.

In one embodiment, during opening of latch system 132, retainer 166 is moved to the left (as seen in FIG. 3) by at least 8.4 mm and is raised upward by at least 9.8 mm from the projection engaging position. In other embodiments, cam 210, cam follower 212 and lever 214 may have other configurations which result in retainer 166 being displaced by different extents with respect to the projection engaging position.

As shown by FIG. 3, once retainer 166 is in the fully withdrawn position, print unit 126 is inserted into dock 138. During such insertion, sloped surfaces 238 of carriage 124 may assist in guiding carrier 144 into place. Upon insertion, notch 204 of projection 160 faces upward, horizontally offset from and below retainer 166.

FIG. 4 illustrates manual actuation of lever 214. FIG. 4 illustrates lever 214 rotated to another position in which springs 208 apply a clockwise rotational moment to retainer 166 or cam follower 212. During such movement of lever 214 from fully open position of FIG. 3 to the position shown in FIG. 4, cam follower 212 abuts fulcrum surface 226 to facilitate rotation of cam follower 212. As shown by FIG. 4, such rotation of lever 214 moves cam follower 212 downward along ramps surface 224 which results in retainer 166 being horizontally moved in the direction indicated by arrow 240 and vertically moved in the direction indicated by arrow 242.

Figure 6:
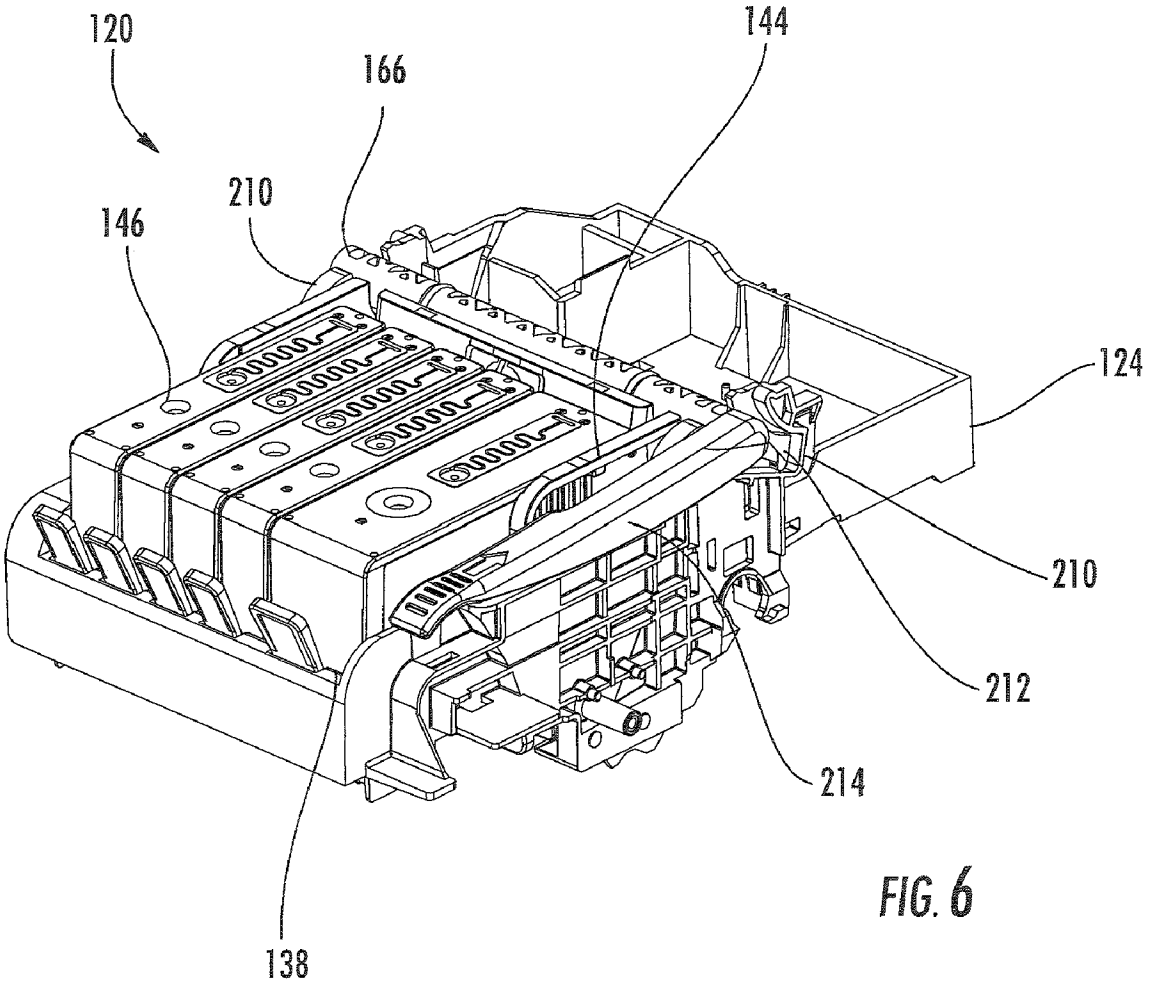
FIG. 6 is a top rear perspective view of the printer of FIG. 5 according to an example embodiment.

FIGS. 5-7 illustrate further rotation of lever 214 to a final position in which latch system 132 is in a print unit retaining state and in which retainer 166 is in the projection engaging position. During such continued rotation of lever 214, foot 234 of cam follower 212 slides down along surface 224. This results in retainer 166 being further displaced horizontally in the direction indicated by arrow 240 and vertically in the direction indicated by arrow 242 until projecting into notch 204 of projection 160. When in the projection engaging position shown in FIGS. 5-7, springs 208 are still stretched and apply a force to retainer 166 so as to create assist in urging print heads 150 of print unit 126 to datumed positions as shown in FIG. 5. In the final projection engaging position, springs 208 applied force to retainer 166 with substantially no rotational moment. Thus, during rotation of lever 214 from the position shown in FIG. 3, to the position shown in FIG. 5, springs 224 initially apply a counter-clockwise moment to retainer 166 (shown in FIG. 3), then apply a clockwise moment to retainer 166 (shown in FIG. 4) and finally apply substantially no moment linear force to retainer 166 (shown in FIG. 5).

Figure 5A:
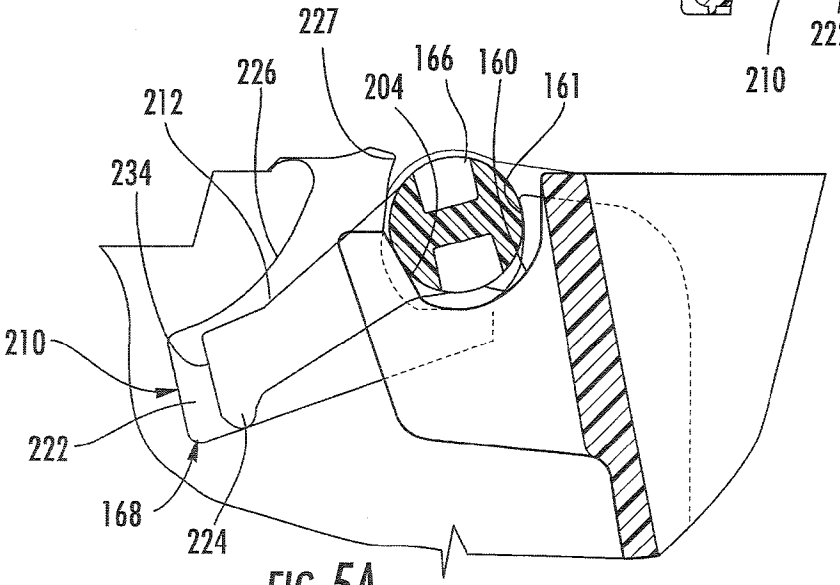
FIG. 5A is an enlarged view of the printer of FIG. 5 taken along line 5-5 according to an example embodiment.

FIG. 5A is an enlarged view of the engagement of retainer 166 with both notches 161 of carriage 124 and notches 204 of projections 160 when retainer 166 is in the projection engaging position shown. In particular, retainer 166 is squeezed between the right side of notch 161 and the left side of notch 204 as seen in FIG. 5. This results in print unit 126 being urged to the left in the positive Y-axis direction urging print unit 126 against the Y-axis datums (not shown) and down in the negative Z-axis direction against the Z-axis datums (not shown). As a result, positional control of print unit 126 relative to the carriage 124 and the media being printed upon may be achieved.

As further shown by FIGS. 5-7, when retainer 166 is in the projection engaging position, lever normal 214 extend at least partially, if not completely, below a top of print unit 126, below a top of at least one of carrier 144 and fluid supply 146. At the same time, retainer 166 and cam follower 212 are also each substantially below a top of print unit 126, below a top of carrier 144 and below a top of fluid supply 146. As a result, carriage 124, print unit 126 and latch system 132 have a greatly reduced height when print unit 126 is secured within carriage 124 and when carriage 124 is being transported across media transport 22 (shown in FIG. 1) during printing.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

The reverse operation of cam axis 188 to withdraw print unit 126 from dock 138 is also illustrated in FIG. 3-7. In particular, FIG. 5 illustrates latch system 132 in the print unit retaining state in which retainer 166 is in the projection engaging position. During rotation of lever 214 in a from the position shown in FIG. 5, foot 234 serves as a rotational axis about which lever 214 pivots against the bias of spring 208 (illustrated as a coil tension spring). The rotational axis provided by foot 234 (the tip of foot 234 that contact surface 224) slides upward and linearly translates along the inclined surface 224, thus serving as a translatable axis. During this first portion of movement or rotation of lever 214. As shown by FIG. 4, continued rotation of lever 214 during a second portion of rotational movement of lever 214 (as seen in FIG. 4) results in a top surface of cam lever 212 bearing against fulcrum surface 226, wherein lever 214 pivots about a second axis provided by fulcrum surface 226 upon such engagement to the position shown FIG. 3 in which retainer 166 is in the withdrawn position, raised out of contact with the projection 60.

What is claimed is:

1. An apparatus comprising:

a dock having a cavity configured to receive a print unit including a print head and fluid supply; and a print unit latch comprising:

a cam coupled to the dock;

a retainer configured to move between a first position in which the retainer extends over and contacts a projection extending from the print unit and extends below a top of the fluid supply to retain the print unit in the cavity of the dock and a second position in which the retainer is raised out of contact with the projection;

a spring having a first portion coupled to the dock and a second portion coupled to the retainer, where the spring resiliently biases the retainer towards the first position; and a lever coupled to the retainer and including a cam follower in engagement with the cam, wherein rotation of the lever moves the cam follower against the cam to move the retainer between the first position and the second position, wherein the cam includes an inclined surface and wherein the cam follower slides upward along the inclined surface in response to rotation of the retainer by the lever.

2. The apparatus of claim 1, wherein at least a substantial length of the lever is configured to extend below the fluid supply of the print unit when the print head assembly is received in the dock.

3. The apparatus of claim 1, wherein at least a substantial length of the lever is configured to extend below the fluid supply of the print unit when the print unit is received in the dock.

4. The apparatus of claim 1, wherein the lever is retained with respect to the dock solely by one or more coil tension springs including the spring such that the lever is rotatable about a linearly translatable axis.

5. The apparatus of claim 1, wherein the dock has a front end having communication contacts and configured to extend proximate to a front end of the print unit when the print unit is inserted into the dock and wherein the retainer and the spring are located proximate the front end of the dock.

6. The apparatus of claim 1, wherein the cam is integrally formed as a single unitary body with a side wall of the dock.

7. The apparatus of claim 1, wherein the cam includes a cavity receiving the cam follower and wherein the cam follower drops into the cavity and is retained in the cavity by the spring, wherein the cavity has a floor, wherein the cam follower slides along the floor as the lever is rotated and wherein the cam follower contacts the floor in both the first position and the second position.

8. The apparatus of claim 7, wherein the cavity has a top fulcrum surface opposite the floor, wherein the cam extends between the floor and the fulcrum surface.

9. The apparatus of claim 8, wherein the cam follower slides along and rotates against the top fulcrum surface during rotation of the lever.

10. The apparatus of claim 1, wherein the spring is coupled to the retainer on a first end of the retainer and wherein the apparatus further comprises a second spring having a first portion coupled to the dock and a second portion coupled to the retainer on a second end of the retainer.

11. The apparatus of claim 1, wherein the retainer horizontally moves away from the fluid supply in response to rotation of the lever about a rotational axis as the rotational axis of the lever translates.

12. The apparatus of claim 1, wherein the projection comprises a hook and wherein the retainer has a centerline horizontally offset from a notch of the hook when the retainer is in the second position.

13. The apparatus of claim 1, wherein the retainer is withdrawn from above the cavity when in the second position.

14. The apparatus of claim 1, wherein a majority of the retainer extends below a top of the fluid supply.

15. The apparatus of claim 1 further comprising the print unit, wherein the print unit includes a carrier, one or more print heads supported by the carrier and one or more fluid supplies carried by the carrier.

16. The apparatus of claim 1, wherein rotation of the lever is about a first axis that translates upward along the inclined surface as the cam follower slides upward along the inclined surface towards the second position and against a bias of the spring.

17. The apparatus of claim 16, wherein rotation of the lever about the first axis occurs during a first portion of rotational movement of the lever and wherein the apparatus further comprises a fulcrum providing a second axis about which the lever rotates during a second portion of rotational movement of the lever.

18. A method comprising:

inserting a print unit having a projection and a fluid supply into a cavity of a dock; and rotating a lever to move a cam follower against a cam to translate a rotational axis of the lever to horizontally and vertically move a retainer against a bias of a spring from a first position above the fluid supply in which the retainer is raised out of contact with the projection to a second position over and in contact with the projection and at least partially below a top of the fluid supply to retain the print unit in the cavity of the dock.

19. An apparatus comprising:

a dock having a cavity configured to receive a print unit including a print head and fluid supply; and a print unit latch comprising:

a cam coupled to the dock;

a retainer configured to move between a first position in which the retainer extends over and contacts a projection extending from the print unit and extends below a top of the fluid supply to retain the print unit in the cavity of the dock and a second position in which the retainer is raised out of contact with the projection;

a spring having a first portion coupled to the dock and a second portion coupled to the retainer, where the spring resiliently biases the retainer towards the first position; and a lever coupled to the retainer and including a cam follower in engagement with the cam, wherein rotation of the lever moves the cam follower against the cam to translate a first rotational axis of the lever against a bias of the spring and to move the retainer from the first position towards the second position.

20. The apparatus of claim 19, wherein the cam includes a cavity receiving the cam follower, wherein the cam follower drops into the cavity and is retained in the cavity by the spring, wherein the cavity has a floor along which the cam follower slides as the lever is rotated.

21. The apparatus of claim 20, wherein the cavity has a top fulcrum surface opposite the floor, wherein the cam extends between the floor and the fulcrum surface and wherein the cam follower slides along and rotates against the top fulcrum surface during rotation of the lever.

22. The apparatus of claim 19, wherein rotation of the lever about the first rotational axis occurs during a first portion of rotational movement of the lever and wherein the apparatus further comprises a fulcrum providing a second axis about which the lever rotates during a second portion of rotational movement of the lever.

* * * * *